US006533087B1

(12) United States Patent
Chen

(10) Patent No.: US 6,533,087 B1
(45) Date of Patent: Mar. 18, 2003

(54) STRUCTURE FOR EXPANDING THE CAPACITY OF LUGGAGE

(76) Inventor: Shou Mao Chen, 344, Sec.1, Chung Shan Rd., Tah-Cha Township, Taichung Hsien (TW)

( * ) Notice: Subject to any disclaimer, the term of this patent is extended or adjusted under 35 U.S.C. 154(b) by 0 days.

(21) Appl. No.: 10/090,177

(22) Filed: Mar. 5, 2002

(51) Int. Cl.[7] ..... A45C 7/00
(52) U.S. Cl. ..... 190/103; 109/107; 383/2
(58) Field of Search ..... 190/103, 100, 190/105, 107, 127, 14, 21, 24; 383/2, 4

(56) References Cited

U.S. PATENT DOCUMENTS 4,588,056 A * 5/1986 Bernbaum ..... 190/107
4,953,673 A * 9/1990 Ambasz ..... 190/103
5,103,945 A * 4/1992 Kaneko ..... 190/107
5,197,580 A * 3/1993 Berman ..... 190/107
5,671,831 A * 9/1997 Chiu ..... 190/103
5,749,446 A * 5/1998 Hsieh ..... 190/107
6,021,874 A * 2/2000 Nykoluk ..... 190/103
6,220,411 B1 * 4/2001 Scicluna et al. ..... 190/103
6,390,259 B1 * 5/2002 Lu ..... 190/103
6,408,997 B1 * 6/2002 Chen ..... 190/103

* cited by examiner

*Primary Examiner*—Lee Young
*Assistant Examiner*—Lien M Ngo
(74) *Attorney, Agent, or Firm*—Harrison & Egbert

(57) ABSTRACT

A luggage is formed of a main shell, a cover body, and an expansion fabric fastened between the main shell and the cover body to enable the cover body to pull away from the main shell so as to expand the capacity of the luggage. The main shell is provided with two support plates, each having one or more connection members. The expansion fabric is provided with one or more locating members. As the expansion fabric is expanded to result in an increase in capacity of the luggage, the connection members of the support plates are joined with the locating members of the expansion fabric, so as to brace firmly the cover body and the expansion fabric.

3 Claims, 10 Drawing Sheets

STRUCTURE FOR EXPANDING THE CAPACITY OF LUGGAGE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a luggage, and more particularly to a structure for expanding capacity of the luggage.

BACKGROUND OF THE INVENTION

As illustrated in FIG. 1, a prior art luggage 10 is formed of a main shell 11, a cover 12, a zipper tape 13, and a zipper 14. The zipper tape 13 is fastened between the main shell 11 and the cover 12 by sewing. The capacity of the prior art luggage 10 can be expanded to an extent by unfastening the zipper tape 13 by means of the zipper 14, thereby resulting in an increase in the capacity of the prior art luggage 10 so as to enable the luggage 10 to hold additional articles. The zipper tape 13 is not provided with a support element to prevent the cover 12 of the prior art luggage 10 from being tilted. In addition, the capacity of the prior art luggage 10 can be expanded to very limited extent. Furthermore, the external appearance of the prior art luggage 10 is affected adversely after the capacity of the prior art luggage 10 is expanded.

BRIEF SUMMARY OF THE INVENTION

The primary objective of the present invention is to provide a luggage structure capable of expanding the capacity of the luggage without resulting in various shortcomings of the prior art luggage described above.

In keeping with the principle of the present invention, the foregoing objective of the present invention is attained by a luggage comprising a main shell, a cover, and an expansion fabric fastened between the main shell and the cover. The main shell is provided with two support plates, each having one or more connection members. The expansion fabric is provided with one or more locating members. As the expansion fabric is expanded to increase the capacity of the luggage, the support plates are caused to turn in the direction toward the inner side of the expansion fabric such that the connection members of the support plates are joined with the locating members of the expansion fabric, and that the expansion fabric and the cover are braced.

The features and the advantages of the present invention will be more readily understood upon a thoughtful deliberation of the following detailed description of the present invention with reference to the accompanying drawings.

DETAILED DESCRIPTION OF THE INVENTION

Figure 1:
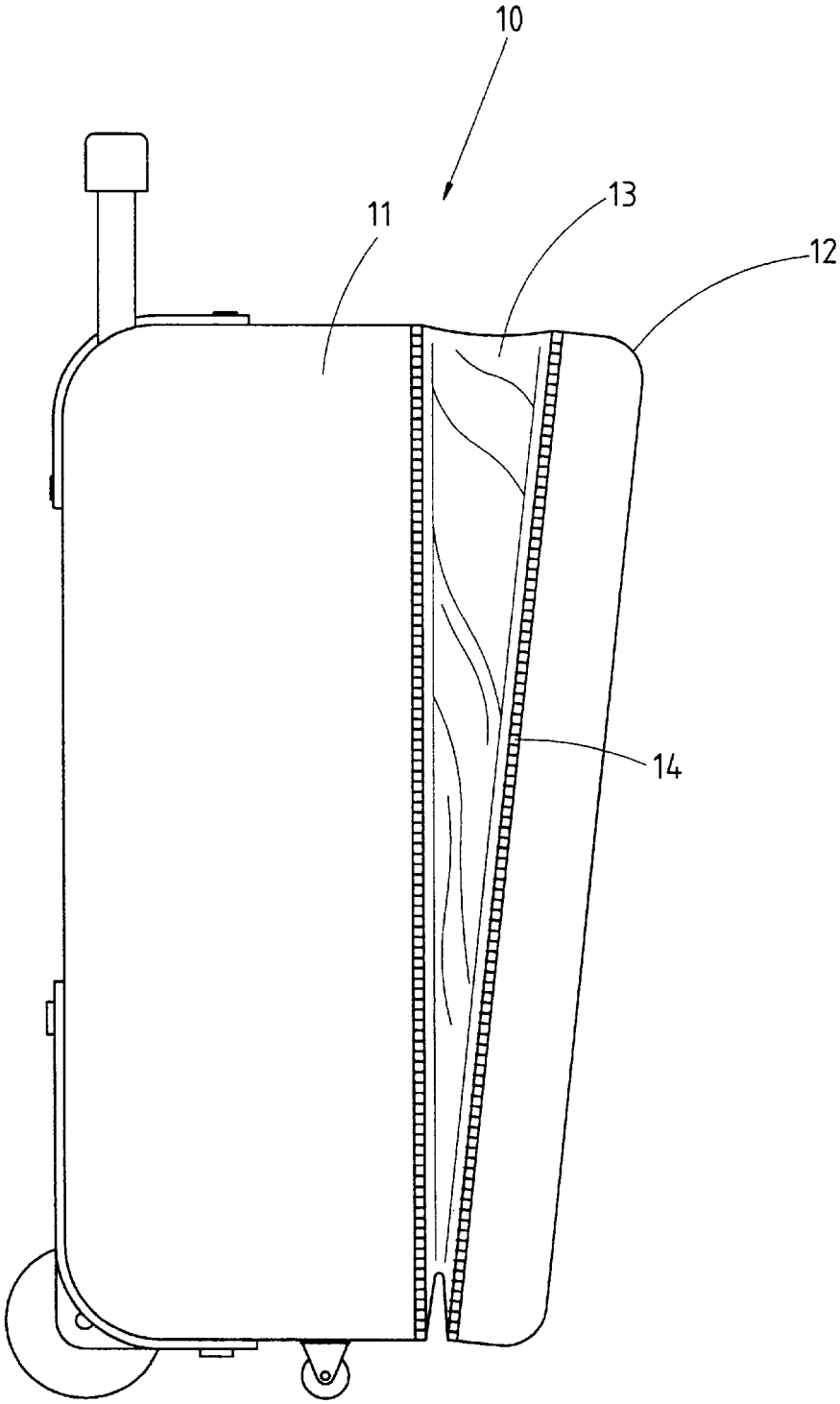
FIG.1 PRIOR ART
FIG. 1 shows a side schematic view of a prior art luggage in use.
Figure 2:
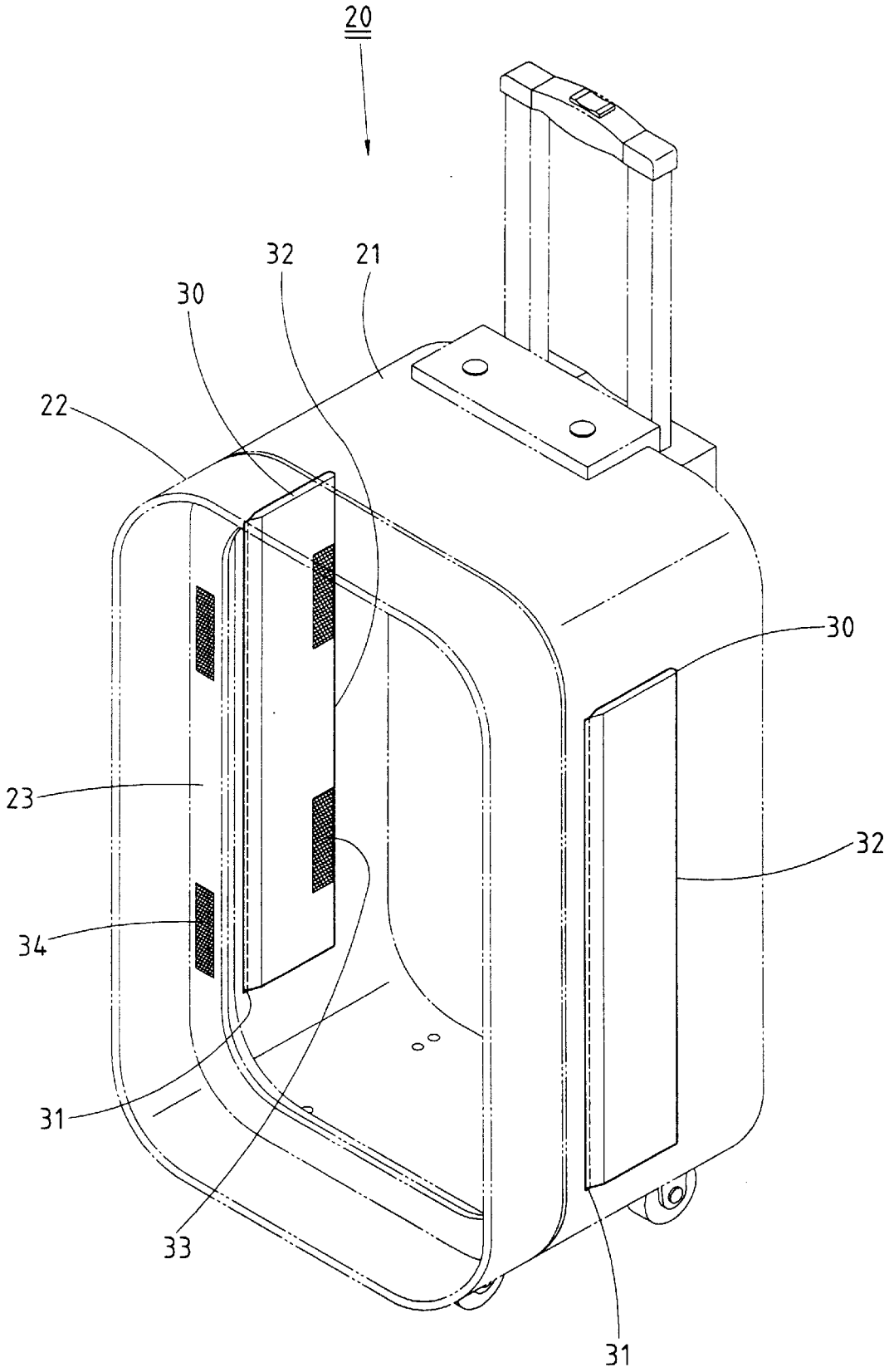
FIG. 2 shows a perspective view of the present invention.
Figure 3:
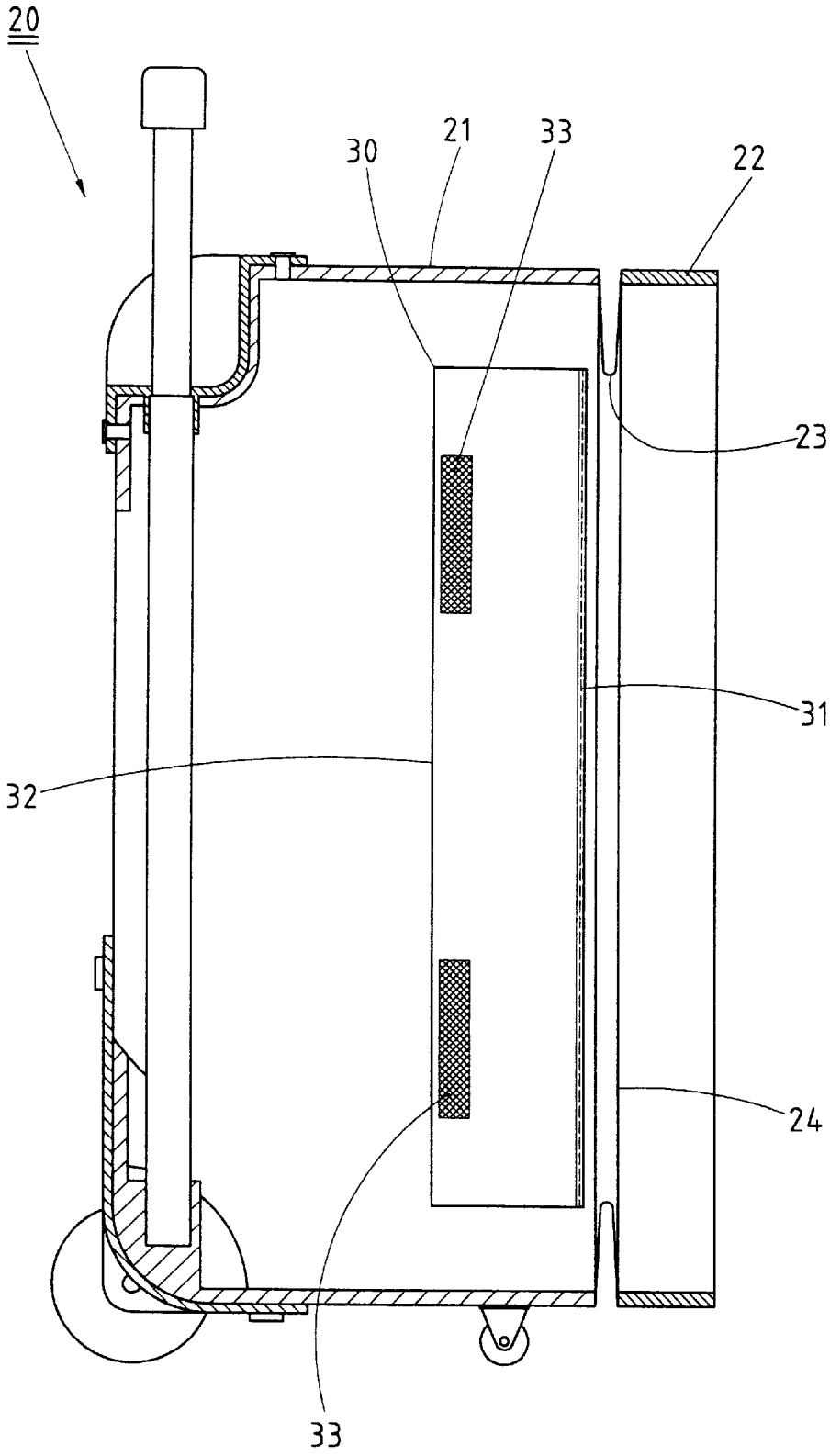
FIG. 3 shows a side sectional view of the present invention.
Figure 4:
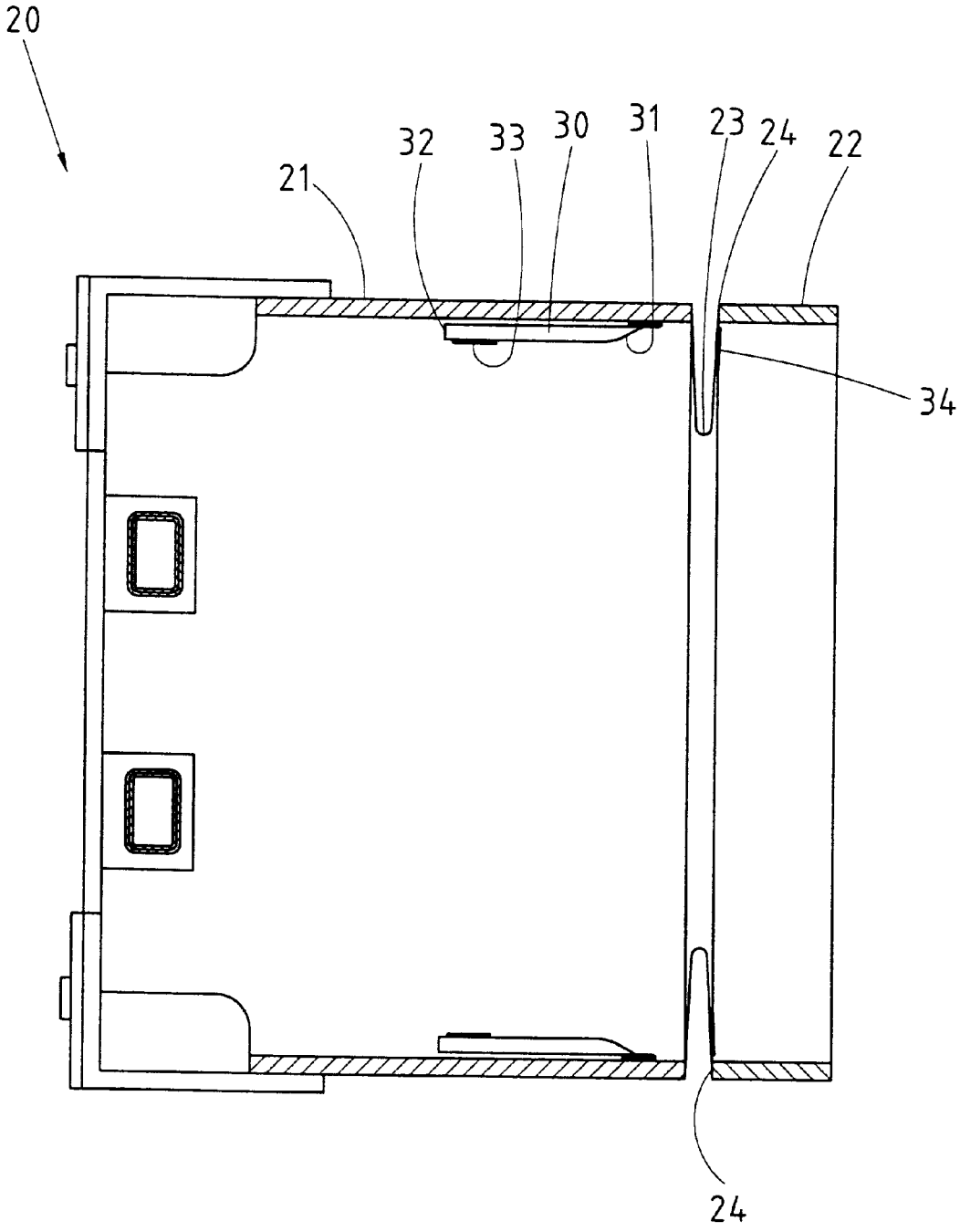
FIG. 4 shows a top sectional view of the present invention.
Figure 5:
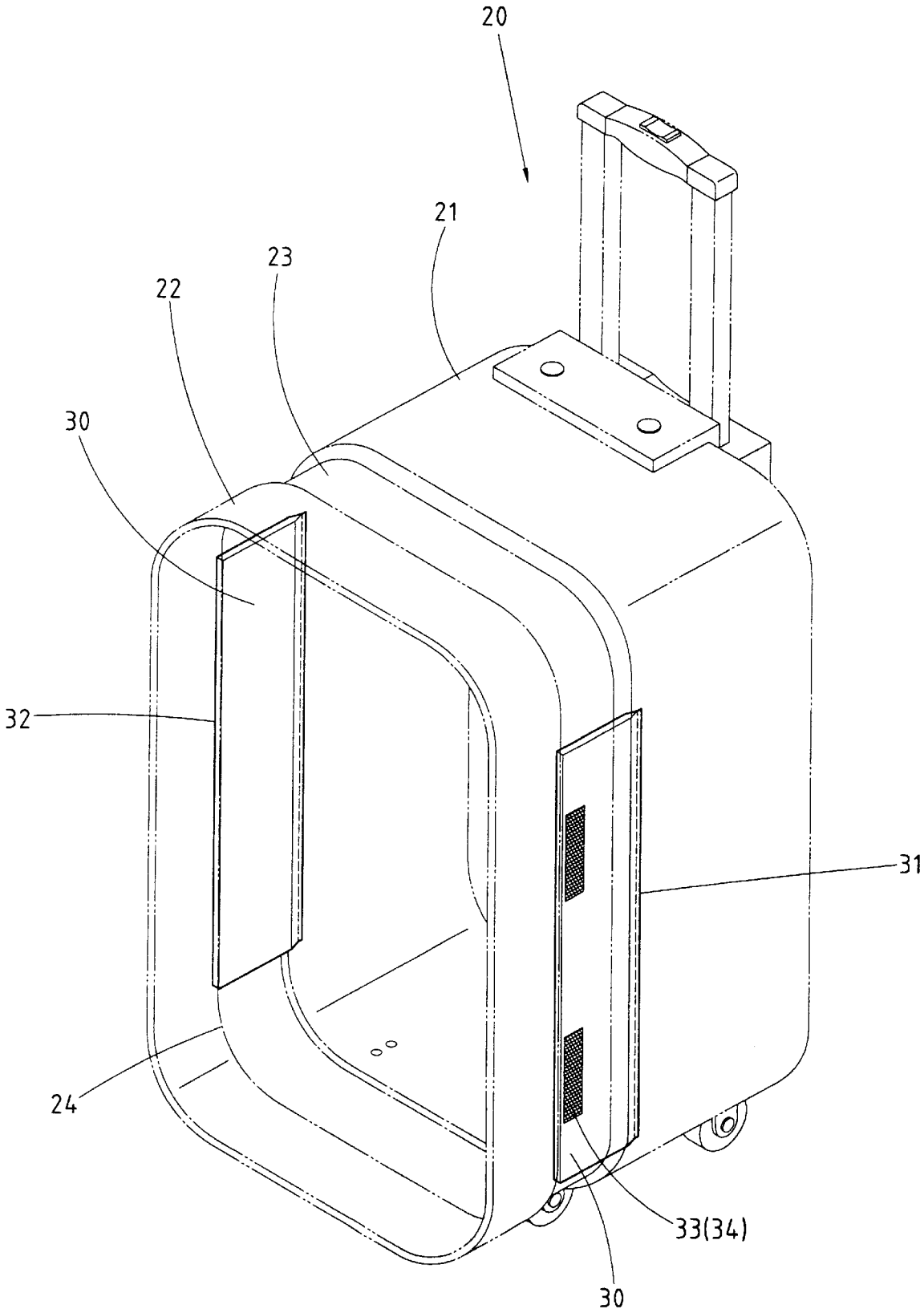
FIG. 5 shows a perspective view of the present invention in expansion state.
Figure 6:
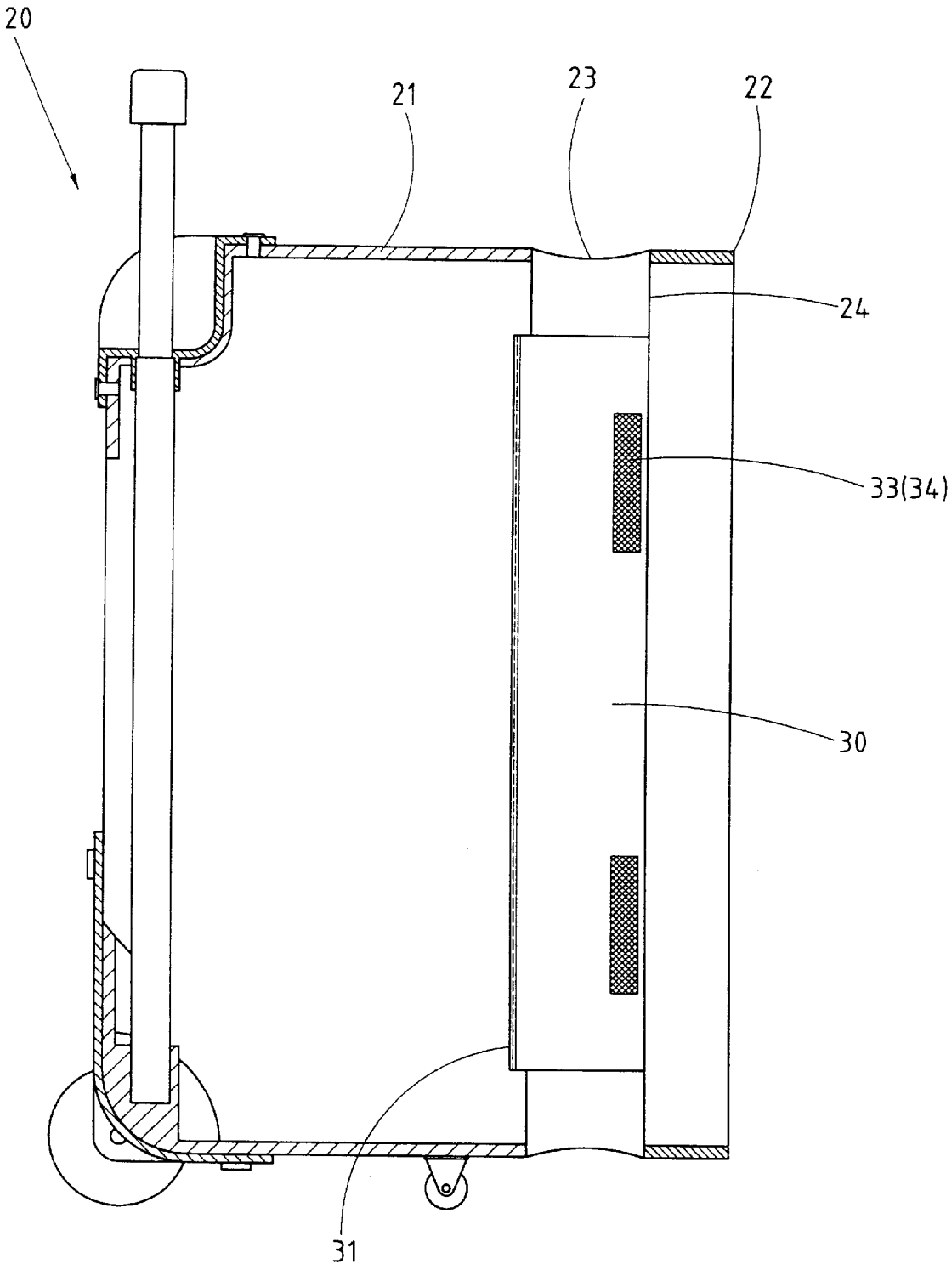
FIG. 6 shows a side sectional view of the present invention in the expansion state.
Figure 7:
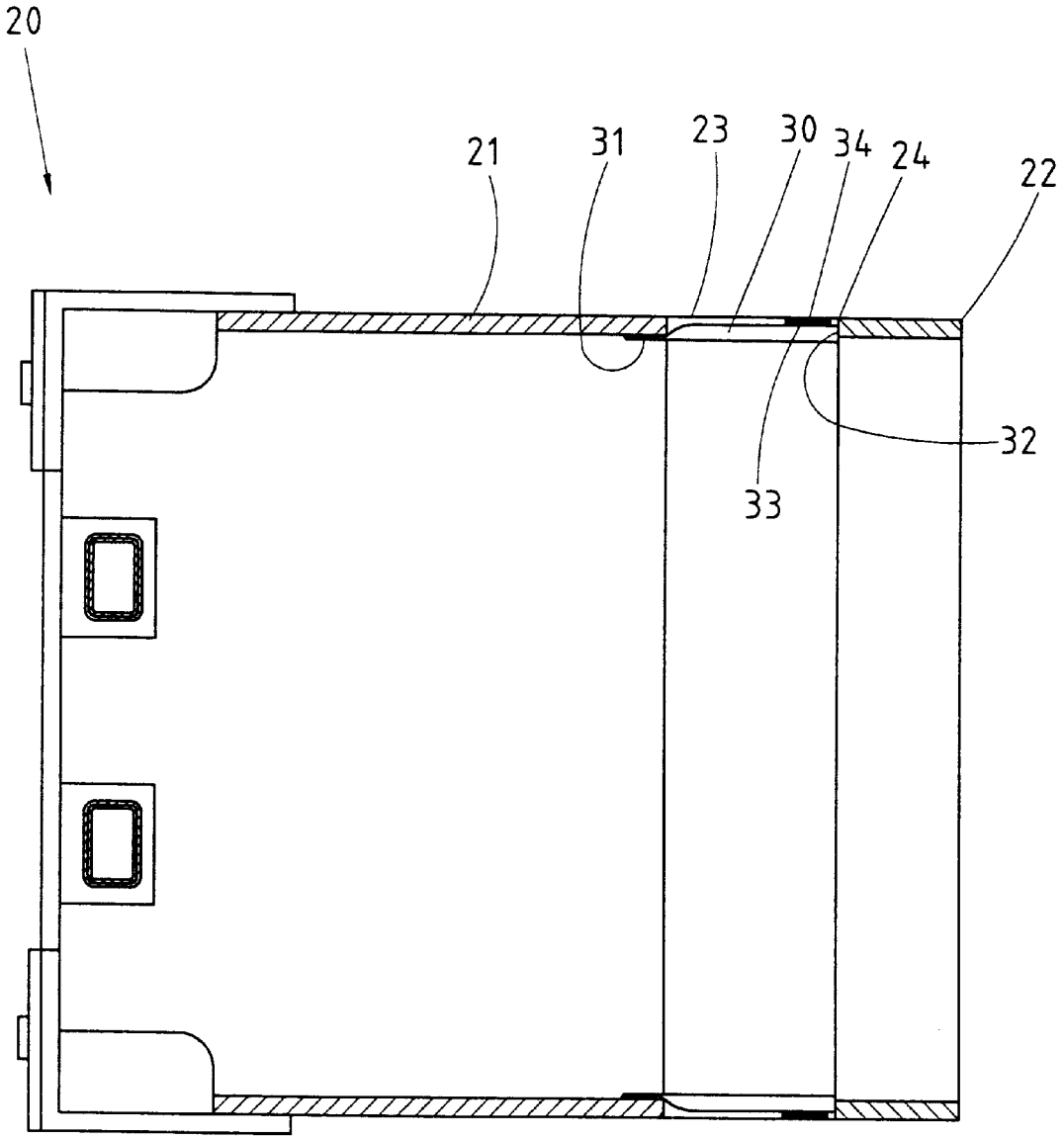
FIG. 7 shows a top sectional view of the present invention in the expansion state.
Figure 8:
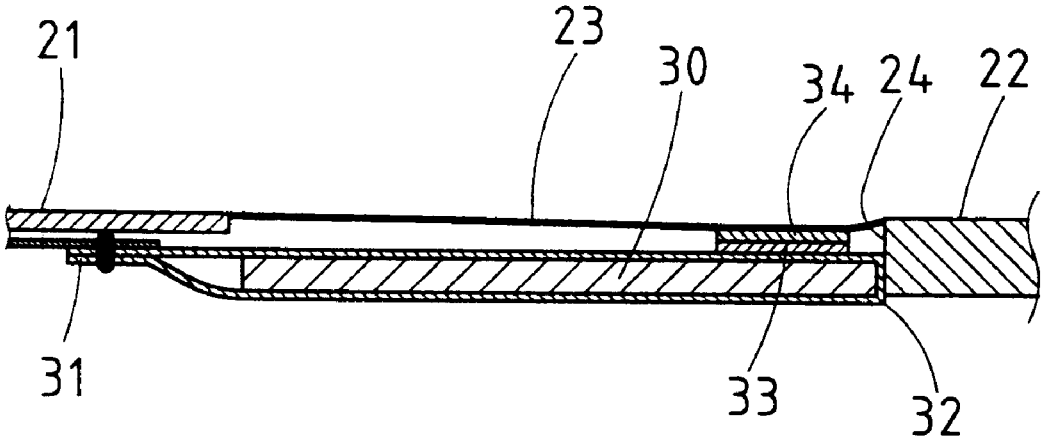
FIG. 8 shows a partial sectional view of the present invention in the expansion state.

As shown in FIGS. 2–10, a luggage 20 of the present invention comprises a main shell 21, a cover body 22, and an expansion fabric 23 fastened between the main shell 21 and the cover body 22 in conjunction with a zipper (not shown in the drawings)

The main shell 21 is provided in two opposite inner side walls with a support plate 30 whose inner side edge 31 is flexibly connected with the inner side of the main shell 21. The support plate 30 is provided in proximity of an outer side edge 32 thereof with one or more connection members 33.

The expansion fabric 23 is provided in two opposite inner sides with one or more locating members 34. As the expansion fabric 23 is expanded to increase the capacity of the luggage 20, the support plates 30 are turned toward the inner side of the expansion fabric 23 such that the connection members 33 of the support plates 30 are joined with the locating members 34 of the expansion fabric 23, and that the expansion fabric 23 and the cover body 22 are thus braced.

The connection members 33 of the support plates 30 and the locating members 34 of the expansion fabric 23 of the luggage 20 of the present invention are Velcro or hook and loop fasterness devices which are also known as magic tapes and are made up of a surface of tiny hooks and a complementary surface of a clinging pile. The surface of tiny hooks and the complementary surface of a clinging pile can be pressed together or pulled apart for easy fastening and unfastening. The connection members 33 of the support plates 30 may be formed of strips of tiny hooks while the locating members 34 of the expansion fabric 23 are formed of complementary strips of a clinging pile.,or vice versa.

Figure 9:
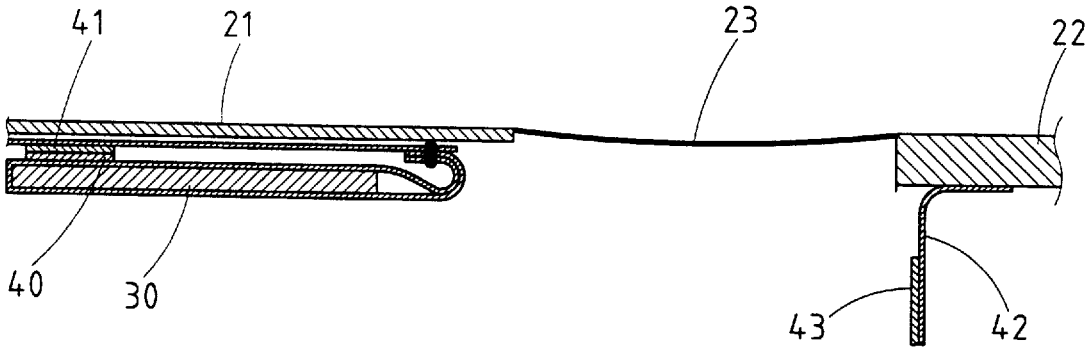
FIG. 9 shows a partial sectional view of another preferred embodiment of the present invention.
Figure 10:
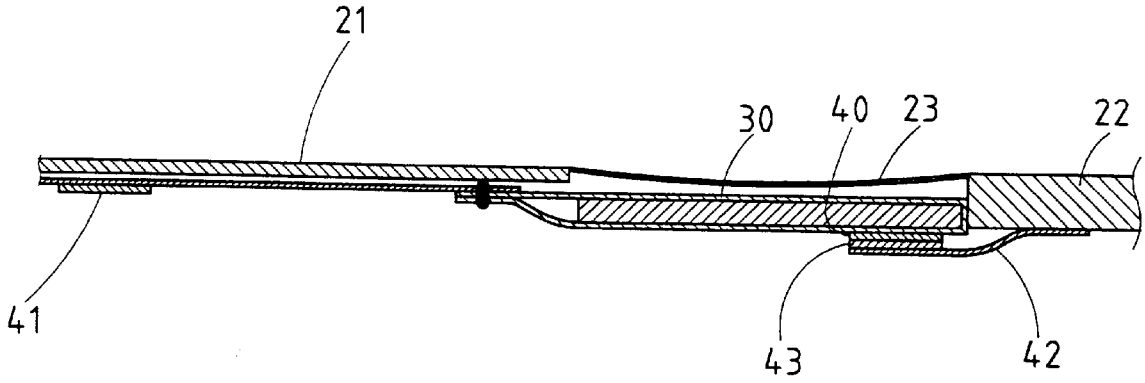
FIG. 10 shows a partial sectional view of another preferred embodiment of the present invention in the expansion state.

As shown in FIGS. 9 and 10, the support plate 30 is provided with a magic tape 40, whereas the main shell 21 is provided with a complementary magic tape 41 corresponding in location to the magic tape 40. The magic tapes 40 and 41 are intended to locate the support plate 30 and the main shell 21. In addition, the cover body 22 is provided in the inner side with a soft tape 42 which is provided in one side thereof with a magic tape 43 complementary to the magic tape 40 of the support plate 30. When the support plate 30 is turned toward the inner side of the expansion fabric 23, the support plate 30 is located by the cover body 22 such that the magic tape 40 of the support plate 30 is joined with the magic tape 43 of the soft tape 42 of the cover body 22, as shown in FIG. 10. The present invention described above is to be regarded in all respect as being illustrative and non-restrictive accordingly the present invention may be embodied in other specific forms without deviating from the spirit thereof the present invention is therefore to be limited only by the scope of the following claims. deviating from the spirit thereof. The present invention is therefore to be limited only by the scopes of the following claims.

I claim:

1. A luggage expandable in capacity thereof, comprising a main shell, a cover body, and an expansion fabric fastened between said main shell and said cover body to enable said cover body to move away from said main shell and to move toward said main shell;

wherein said main shell is comprised of, in two opposite inner sides, two support plates each of the support plates fastened movably, on each of the inner sides said support plate being comprised of one or more connection members;

wherein said expansion fabric is comprised of, in two opposite inner sides, one or more locating members corresponding in location to said connection members of said support plate;

wherein said cover body is pulled in a direction away from said main shell to cause said expansion fabric to expand to result in an increase in capacity of said luggage such that said connection members of said support plate are joined with said locating members of said expansion fabric, and such that an outer side edge of said support plate is rested against an inner frame edge of said cover body.

2. The luggage as defined in claim 1, wherein said connection members of said support plate comprise magic tapes; and wherein said locating members of said expansion fabric comprise magic tapes complementary to said magic tapes of said support plate.

3. The luggage as defined in claim 1, wherein said support plate is comprised of a magic tape;

wherein said main shell is comprised of a magic tape complementary to said magic tape of said support plate for locating said support plate such that said magic tape of said support plate is fastened to said magic tape of said main shell;

wherein said cover body is comprised of, in an inner side, a tape having in one side thereof a magic tape complementary to said magic tape of said support plate whereby said support plate is located by said cover body such that said magic tape of said support plate is joined with said magic tape of said tape of said cover body at the time when the capacity of said luggage is expanded.

* * * * *